US010023824B2

(12) United States Patent
Bender

(10) Patent No.: US 10,023,824 B2
(45) Date of Patent: Jul. 17, 2018

(54) LUBRICANT COMPOSITION

(71) Applicant: Afton Chemical Corporation, Richmond, VA (US)

(72) Inventor: Jonathan W. Bender, Richmond, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 13/860,786

(22) Filed: Apr. 11, 2013

(65) Prior Publication Data

US 2014/0309150 A1 Oct. 16, 2014

(51) Int. Cl.
*C10M 137/04* (2006.01)
*C10M 137/10* (2006.01)

(52) U.S. Cl.
CPC ..... *C10M 137/105* (2013.01); *C10M 137/10* (2013.01); *C10M 137/04* (2013.01); *C10M 2219/046* (2013.01); *C10M 2219/106* (2013.01); *C10M 2223/045* (2013.01); *C10M 2223/047* (2013.01); *C10N 2210/02* (2013.01); *C10N 2230/06* (2013.01); *C10N 2230/12* (2013.01); *C10N 2230/42* (2013.01); *C10N 2230/43* (2013.01); *C10N 2230/52* (2013.01); *C10N 2240/02* (2013.01); *C10N 2240/04* (2013.01); *C10N 2240/08* (2013.01)

(58) Field of Classification Search
CPC ..... C10M 137/04; C10M 137/105; C10M 137/10; C10M 2223/045; C10M 2219/106; C10M 2223/047; C10M 2219/046; C10N 2240/08; C10N 2230/43; C10N 2230/12; C10N 2240/04; C10N 2230/52; C10N 2230/42; C10N 2210/02; C10N 2230/06; C10N 2240/02
USPC ..... 508/272, 370, 433
See application file for complete search history.

(56) References Cited

U.S. PATENT DOCUMENTS

| | | | | |
|---|---|---|---|---|
| 2,719,126 | A * | 9/1955 | Fields et al. | 508/273 |
| 3,634,515 | A | 1/1972 | Piasek et al. | |
| 4,152,499 | A | 5/1979 | Boerzel et al. | |
| 4,234,435 | A | 11/1980 | Meinhardt et al. | |
| 4,727,798 | A | 3/1988 | Murray et al. | |
| 5,739,355 | A | 4/1998 | Gateau et al. | |
| 5,750,477 | A | 5/1998 | Sumiesjski et al. | |
| 5,925,600 | A | 7/1999 | Atherton | |
| 6,103,673 | A | 8/2000 | Sumiejski et al. | |
| 6,191,330 | B1 | 2/2001 | Matsuno et al. | |
| 6,225,266 | B1 | 5/2001 | Watts et al. | |
| 6,242,393 | B1 | 6/2001 | Ishida et al. | |
| 6,262,000 | B1 | 7/2001 | Reeve et al. | |
| 6,306,060 | B1 | 10/2001 | Dutson et al. | |
| 6,320,088 | B1 | 11/2001 | Matsuno et al. | |
| 6,372,696 | B1 | 4/2002 | Tipton | |
| 6,573,223 | B1 * | 6/2003 | Vinci | 508/192 |
| 6,638,417 | B2 | 10/2003 | Ishida et al. | |
| 6,736,036 | B2 | 5/2004 | Chiba et al. | |
| 7,214,649 | B2 | 5/2007 | Loper et al. | |
| 7,645,726 | B2 | 1/2010 | Loper | |
| 7,732,390 | B2 | 6/2010 | Kadkhodayan et al. | |
| 7,897,696 | B2 | 3/2011 | Huang et al. | |
| 8,048,831 | B2 | 11/2011 | Loper | |
| 2001/0034305 | A1 | 10/2001 | Komatsubara et al. | |
| 2002/0019288 | A1 | 2/2002 | Yamamoto | |
| 2003/0181339 | A1 | 9/2003 | Watts et al. | |
| 2007/0142247 | A1 * | 6/2007 | Baillargeon et al. | 508/279 |
| 2009/0156444 | A1 | 6/2009 | Aguilar et al. | |
| 2009/0186789 | A1 * | 7/2009 | Nagakari et al. | 508/430 |
| 2009/0192063 | A1 | 7/2009 | Gray et al. | |
| 2012/0101017 | A1 | 4/2012 | Duggal | |

FOREIGN PATENT DOCUMENTS

| | | | |
|---|---|---|---|
| JP | 10259393 | A1 | 9/1998 |
| JP | 11293272 | A1 | 10/1999 |
| JP | 2000355695 | A1 | 12/2000 |
| JP | 2011019988 | A1 | 1/2001 |
| JP | 2004035620 | A * | 2/2004 |

OTHER PUBLICATIONS

Guan, Z., et al., "Lubricating Oil Application and Procurement Guidelines," China Petrochemical Press, published in Sep. 2010, pp. 147-149.

Third Chinese Office Action; dated Nov. 18, 2016 for CN Application No. 201410141722.9.

* cited by examiner

*Primary Examiner* — Taiwo Oladapo

(74) *Attorney, Agent, or Firm* — Mendelsohn Dunleavy, P.C.

(57) ABSTRACT

A lubricant composition and a method of lubricating off-road vehicles and/or machinery. The lubricant composition includes (i) a base oil, (ii) at least one ashless component (A) having the structure $P(=S)(SR^1)(OR^2)(OR^3)$, wherein $R^1$, $R^2$ and $R^3$ are independently selected form the group consisting of alkyl, aryl, alkylaryl, cycloalkyl, alcohol, carboxylic acid and ester having 1 to 24 carbon atoms; and (iii) at least one component (B) being a metal dialkyl dithio phosphate salt. The total of ashless components (A) provides to the lubricant composition from 0.010 to 0.080 wt. % phosphorus based on the total weight of the lubricant composition and the total of components (B) provides to the lubricant composition from 0.010 to 0.080 wt. % phosphorus based on the total weight of the lubricant composition.

15 Claims, No Drawings

LUBRICANT COMPOSITION

TECHNICAL FIELD

The invention relates to a lubricant composition, in particular a lubricant composition used for lubricating a transmission, final drive and wet brake. Furthermore, the invention relates to the use of a lubricant composition for off-road applications.

BACKGROUND AND SUMMARY

Modern heavy vehicle machinery, for example earth moving equipment, is continually updated to meet increasing consumer demands. Significant improvements in transmissions and final drives in heavy vehicle machinery have increased equipment durability and productivity and new and diverse friction materials are continually being developed to further enhance performance. Providing the correct lubricants to support these new designs plays a significant role in achieving maximum life and performance for the vehicle.

In the early 1990s, Caterpillar Corporation introduced a new set of transmission and drive train fluid requirements, designated as "Caterpillar TO-4" specification (version Jun. 23, 2005), for use in Caterpillar's heavy vehicle machinery. Lubricant compositions which meet the requirements of the "Caterpillar TO-4" specification are considered to be suitable for off-road applications. All Caterpillar TO-4 lubricant compositions must comply with a number of fluid properties including certain wear, viscometric and friction conditions as set out in the Caterpillar TO-4 specification. Many of the additives used in final drive and powershift transmission (FDPT) lubricants are multifunctional and there is often a conflict generated between properties, such as the scuffing load capacity, copper corrosion performance and bearing pitting performance. These conflicts inevitably mean that additives must be carefully selected and balanced. Accordingly, it has proven difficult for additive companies to meet Caterpillar TO-4 requirements, much less improve significantly on any of the performance thresholds.

In particular a Caterpillar TO-4 compliant lubricant composition has to fulfill specific requirements as to the dynamic and static friction properties of the lubricant composition. Crankcase lubricant compositions usually do not fulfill the requirements as to the dynamic and static friction properties according to the Caterpillar TO-4 specification.

Because crankcase lubricant compositions typically contain friction modifiers, e.g. molybdenum containing friction modifiers and organic friction modifiers like glycerol monooleate, the dynamic and static friction properties become too low to qualify as a Caterpillar TO-4 compliant lubricant composition.

US 2009/0192063 A1 discloses a lubricating composition comprising an oil of lubricating viscosity formulated with an additive package comprising at least one overbased metal detergent, at least one neutral metal detergent and at least one phosphorus-based wear preventative. Furthermore, US 2009/0192063 A1 discloses methods for improving oxidation performance in a Caterpillar TO-4 fluid for use in heavy vehicle machinery.

The object of the invention is to provide an improved lubricant composition, in particular a lubricant composition which meets the Caterpillar TO-4 requirements and has an improved scuffing load capacity, copper corrosion performance and bearing pitting performance The object of invention is solved by a lubricant composition as disclosed herein. The lubricant composition according to the invention comprises a base oil, at least one ashless component (A) having the structure $P(=S)(SR^1)(OR^2)(OR^3)$, wherein $R^1$, $R^2$ and $R^3$ are independently selected from the group consisting of alkyl, aryl, alkylaryl, cycloalkyl, alcohol, carboxylic acid and ester having 1 to 24 carbon atoms; and at least one component (B) being a metal dialkyl dithio phosphate salt, wherein the total of ashless components (A) provides to the lubricant composition from 0.010 to 0.080 wt.-% phosphorus based on the total weight of the lubricant composition and the total of components (B) provides to the lubricant composition from 0.010 to 0.080 wt.-% phosphorus based on the total weight of the lubricant composition.

Surprisingly, the lubricant compositions of the present invention are able to meet the TO-4 specification and have an improved scuffing load capacity, copper corrosion performance and/or bearing pitting performance. In addition, the present invention is able to accomplish this improvement with a low treat rate additive package which reduces additive shipping costs, improves plant through-put, and provides economic benefits to lubricant blenders in terms of lower net additive treat costs.

DETAILED DESCRIPTION OF EXEMPLARY EMBODIMENTS

In one embodiment $R^1$, $R^2$ and $R^3$ of the ashless component (A) may be independently branched or not branched. In another embodiment $R^1$, $R^2$ and $R^3$ may be independently substituted by at least one heteroatom in addition to carbon and hydrogen, such as chlorine, sulfur, oxygen or nitrogen. In yet another embodiment $R^1$, $R^2$ and $R^3$ independently may have 2 to 8 carbon atoms. In still another embodiment $R^1$ may be derived from a reactive olefin and/or is either $—CH_2—CHR^4—C(=O)O—R^5$ or $—R^6—OC(=O)CH_2—CHC(=O)O—R^7$, wherein $R^4$ is H or the same as $R^2$ or $R^3$, and $R^5$, $R^6$ and $R^7$ are independently the same as $R^2$ or $R^3$.

The metal of the component (B) may be selected from the group consisting of alkali metals, alkaline earth metals, aluminum, lead, tin, molybdenum, manganese, nickel, copper, titanium, and zinc. In one embodiment the alkyl groups of the component (B) may contain from 1 to 18 carbon atoms. In another embodiment the alkyl groups of the component (B) may be independently selected from ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, and butenyl. In yet another embodiment 100 mole percent of the alkyl groups of component (B) may be derived from primary alcohols. In still another embodiment component (B) comprises at least one zinc dialkyl dithio phosphate represented by the following formula:

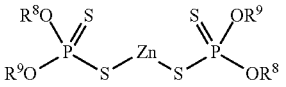

wherein $R^8$ and $R^9$ may be the same or different hydrocarbyl moieties containing from 1 to 18 carbon atoms.

The total of ashless components (A) may provide at least 0.015, preferably at least 0.020 wt.-% and/or at most 0.075, preferably at most 0.070 wt.-% phosphorus based on the total weight of the lubricant composition. In another embodiment the total of ashless components (A) may provide at least 0.025, preferably at least 0.030 wt. % and/or at most 0.065 to 0.060 wt.-% phosphorus based on the total weight of the lubricant composition. In yet another embodiment the total of ashless components (A) may provide at least 0.035, preferably at least 0.040 wt. % and/or at most 0.055 to 0.050 wt.-% phosphorus based on the total weight of the lubricant composition.

The total of components (B) may provide at least 0.015, preferably at least 0.020 wt.-% and/or at most 0.075, preferably at most 0.070 wt.-% phosphorus based on the total weight of the lubricant composition. In another embodiment the total of components (B) may provide at least 0.025, preferably at least 0.030 wt. % and/or at most 0.065 to 0.060 wt.-% phosphorus based on the total weight of the lubricant composition. In yet another embodiment the total of components (B) may provide at least 0.035, preferably at least 0.040 wt. % and/or at most 0.055 to 0.050 wt.-% phosphorus based on the total weight of the lubricant composition.

The total phosphorus content provided by ashless components (A) and components (B) may be from 0.06 to 0.15, preferably 0.07 to 0.14 wt.-% phosphorus based on the total weight of the lubricant composition. In another embodiment the total phosphorus content provided by ashless components (A) and components (B) may be from 0.08 to 0.13, preferably 0.09 to 0.12 wt.-% phosphorus based on the total weight of the lubricant composition.

The ratio of wt.-% phosphorus based on the total weight of the lubricant composition provided by component (A) to wt.-% phosphorus based on the total weight of the lubricant composition provided by component (B) may be from 1:4 to 4:1, preferably from 1:3 to 3:1. In another embodiment the ratio of wt.-% phosphorus based on the total weight of the lubricant composition provided by component (A) to wt.-% phosphorus based on the total weight of the lubricant composition provided by component (B) may be from 1:1.5 to 1.5:1, preferably from 1:1.3 to 1.3:1, more preferably from 1:1.2 to 1.2:1, most preferably 1:1.

The lubricant composition may further comprise at least one component (C) which is a thiadiazole or derivative thereof. In one embodiment the thiadiazole may be 2,5-dimercapto-1,3,4-thiadiazole (DMTD) or a derivative thereof. Derivatives of DMTD may include: 2-hydrocarbyldithio-5-mercapto-1,3,4-thiadiazole or 2,5-bis-(hydrocarbyldithio)-1,3,4-thiadiazole and mixtures thereof; carboxylic esters of DMTD; condensation products of [alpha]-halogenated aliphatic monocarboxylic acids with DMTD; reaction products of unsaturated cyclic hydrocarbons and unsaturated ketones with DMTD; reaction products of an aldehyde and a diaryl amine with DMTD; amine salts of DMTD; dithiocarbamate derivatives of DMTD; reaction products of an aldehyde, and an alcohol or aromatic hydroxy compound, and DMTD; reaction products of an aldehyde, a mercaptan and DMTD; 2-hydrocarbylthio-5-mercapto-1,3,4-thiadiazole; and products from combining an oil soluble dispersant with DMTD; and mixtures thereof.

The total of components (C) may provide to the lubricant composition from 0.010 to 0.5 wt.-%, preferably from 0.015 to 0.2 wt.-% sulfur based on the total weight of the lubricant composition. In another embodiment the total of components (C) may provide to the lubricant composition from 0.020 to 0.10, preferably from 0.025 to 0.060 wt.-% sulfur based on the total weight of the lubricant composition.

The base oil used in the lubricant composition may be selected from any of the base oils in Groups I-V as specified in the American Petroleum Institute (API) Base Oil Interchangeability Guidelines. Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may sometimes be referred to as synthetic fluids in the industry.

The base oil used in lubricant composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof. Unrefined oils are those derived from a natural, mineral, or synthetic source with or without little further purification treatment. Refined oils are similar to unrefined oils except that they have been treated by one or more purification steps, which may result in the improvement of one or more properties. Examples of suitable purification techniques are solvent extraction, secondary distillation, acid or base extraction, filtration, percolation, and the like. Oils refined to the quality of an edible oil may or may not be useful. Edible oils may also be called white oils. In some embodiments, lubricant compositions are free of edible or white oils. Re-refined oils are also known as reclaimed or reprocessed oils. These oils are obtained in a manner similar to that used to obtain refined oils using the same or similar processes. Often these oils are additionally processed by techniques directed to removal of spent additives and oil breakdown products.

Mineral oils may include oils obtained by drilling, or from plants and animals and mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully-hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In an embodiment, oils may be prepared by a Fischer-Tropsch gas-to-liquid synthetic procedure as well as from other gas-to-liquid oils.

The amount of the base oil present may be the balance remaining after subtracting from 100 wt. % the sum of the amount of the performance additives. For example, the base oil may be present in the lubricant composition in an amount greater than 50 wt.-%, greater than 60 wt.-%, greater than 70 wt.-%, greater than 80 wt.-%, greater than 85 wt.-%, or greater than 90 wt.-%.

The lubricant composition may optionally comprise one or more neutral, low based, or overbased detergents, and mixtures thereof. Suitable detergent substrates include phenates, sulfur containing phenates, sulfonates, calixarates, salixarates, salicylates, carboxylic acids, carboxylates, phosphorus acids, mono- and/or di-thiophosphoric acids, alkyl phenols, sulfur coupled alkyl phenol compounds and methylene bridged phenols. Suitable detergents and their methods of preparation are described in greater detail in numerous patent publications, including U.S. Pat. No. 7,732,390, and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or dialkylarylsulfonic acids with the aryl group being one of benzyl, tolyl, and xylyl.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate may be an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. Such salts are commonly referred to as overbased, hyperbased, or superbased salts and may be salts of organic sulfur acids, carboxylic acids, or phenols.

The overbased detergent may have a metal ratio of from 1.1:1, or from 2:1, or from 4:1, or from 5:1, or from 7:1, or from 10:1. The detergent may be present at 0.001wt.-% to 20 wt.-%, or 0.01 wt.-% to 10 wt.-%, or 0.1 wt.-% to 8 wt. %, or 1 wt. % to 4 wt. %, or greater than 4 wt. % to 8 wt. % on the total weight of the lubricant composition.

In one embodiment the lubricant composition may comprise at least one metal sulfonate detergent, preferably a branched metal sulfonate detergent. One beneficial effect of using such a detergent is to improve dynamic and/or static friction properties as determined by the SEQ 1223 friction test according to the CAT TO-4 specification.

The metal sulfonate detergent may be an overbased alkaline earth metal sulfonate detergent. The overbased alkaline earth metal sulfonate may be formed of a sulfonic acid prepared by sulfonating an aromatic compound alkylated with an alkyl group made by a process comprising oligomerizing an olefin containing from 3 to 10 carbon atoms, wherein said alkyl group contains 16 to 40 carbon atoms. The aromatic compound may be alkylated with a linear alkyl group, a branched alkyl group or a mixture thereof. In one embodiment the olefin may be selected from the group consisting of propylene and butylene. In another embodiment the olefin may be butylene and the alkyl group may contain an average of between 16 and 24 carbon atoms.

In a preferred embodiment the overbased alkaline earth metal sulfonate detergent may be an overbased calcium sulfonate detergent. The overbased calcium sulfonate detergent may have a Total Base Number (TBN) ranging from 200 to 400 mg KOH/g. In one embodiment the overbased calcium sulfonate detergent may provide to the lubricant composition from 0.01 to 0.8 wt.-%, preferably from 0.1 to 0.6 wt.-%, more preferably from 0.15 to 0.5 wt.-%, most preferably from 0.2 to 0.4 wt.-%, calcium based on the total weight of the lubricant composition.

The lubricant composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in a range of 350 to 5000, or 500 to 3000, or 800 to 2200. Succinimide dispersants and their preparation are disclosed, for instance in U.S. Pat. Nos. 7,897,696 and 4,234,435. Succinimide dispersants are typically an imide formed from a polyamine, typically a poly(ethyleneamine).

In some embodiments the lubricant composition preferably comprises at least one polyisobutylene succinimide dispersant derived from polyisobutylene with number average molecular weight in the range 350 to 5000, or 500 to 3000, or 800 to 2200. The polyisobutylene succinimide may be used alone or in combination with other dispersants.

In some embodiments, polyisobutylene (PIB), when included, may have greater than 50 mol %, greater than 60 mol %, greater than 70 mol %, greater than 80 mol %, or greater than 90 mol % content of terminal double bonds. Such a PIB is also referred to as highly reactive PIB ("HR-PIB"). HR-PIB having a number average molecular weight ranging from 800 to 5000 is suitable for use in embodiments of the present disclosure. Conventional non-highly reactive PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable. Such an HR-PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR-PIB may lead to higher conversion rates in the reaction, as well as lower amounts of sediment formation, due to increased reactivity.

In embodiments the lubricant composition comprises at least one dispersant derived from polyisobutylene succinic anhydride. In an embodiment, the dispersant may be derived from a polyalphaolefin (PAO) succinic anhydride. In an embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515. A suitable class of dispersants may be high molecular weight esters or half ester amides. The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 describe some suitable post-treatment methods and post-treated products.

The dispersant, if present, can be used in an amount sufficient to provide up to 20 wt. %, based upon the total weight of the lubricant composition. The amount of the dispersant that can be used may be from 0.001 wt.-% to 5 wt.-%, preferably from 0.01 wt.-% to 2 wt.-%, more preferably from 0.1 wt.-% to 1 wt.-%, most preferably from 0.15 wt.-% to 0.5 wt.-% based on the total weight of the lubricant composition. In an embodiment the lubricant composition utilizes a mixed dispersant system.

The lubricant composition may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as sulfurized polyisobutylene, sulfurized fatty acids, dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof. Preferred EP agents are sulfurized polyisobutylene and sulfurized fatty acids.

The lubricant composition may contain from 0.001 to 2 wt.-%, preferably from 0.01 to 0.3 wt.-%, more preferably from 0.02 to 0.15 wt.-%, most preferably from 0.03 to 0.1 wt.-% of one ore more EP agents based on the total weight of the lubricant composition.

The lubricant composition may optionally contain one or more rust inhibitors. Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable rust inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic rust inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. Preferred rust inhibitors include dinonylnaphthalene sulfonate (NASUL ZS, King Industries, Inc.), dimer acid, polyisobutylene anhydride and tetrapropenyl anhydride.

The rust inhibitor can be used in an amount from 0.001 wt.-% to 5 wt.-%, preferably from 0.01 wt.-% to 3 wt.-%, more preferably from 0.1 wt.-% to 2 wt.-%, most preferably from 0.2 wt.-% to 0.8 wt.-%, based upon the total weight of the lubricant composition.

The lubricant composition may optionally contain one or more antioxidants. Antioxidant compounds are known and include, for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidants may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In an embodiment the hindered phenol antioxidant may be an ester and may include, e.g., an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight of the antioxidant, based upon the final weight of the lubricating oil composition. In some embodiments, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In an embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges of from 0.001 wt.-% to 20 wt.-%, or 0.01 wt.-% to 15 wt.-%, or 0.1 wt.-% to 10 wt.-%, or 1 wt.-% to 5 wt.-% based on the total weight of the lubricant composition.

The lubricant composition may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The lubricant composition herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be from 0.001 wt.-% to 25 wt.-%, or 0.01 wt.-% to 20 wt.-%, or 0.1 wt.-% to 15 wt.-%, or 0.1 wt.-% to 12 wt.-%, or 0.5 wt.-% to 10 wt.-% based on the total weight of the lubricant composition.

The lubricant composition may optionally contain one ore more pour point depressants. Suitable pour point depressants may include esters of maleic anhydride-styrene, polymethacrylates, polymethylmethacrylates, polyacrylates or polyacrylamides or mixtures thereof. Pour point depressants may be present in amount from 0.001 wt.-% to 1 wt.-%, or 0.01 wt.-% to 0.5 wt.-%, or 0.02 wt.-% to 0.04 wt.-% based upon the total weight of the lubricant composition.

The lubricant composition may optionally contain one or more anti foam agents. Suitable antifoam agents may include silicon-based compounds, such as siloxanes. Other antifoam agents may include copolymers of ethyl acrylate and 2-ethylhexylacrylate and optionally vinyl acetate. The antifoam agent can be used in an amount of 0.001 wt.-% to 5 wt.-%, preferably 0.005 wt.-% to 3 wt.-%, more preferably 0.1 wt.-% to 2 wt.-%, based upon the total weight of the lubricant composition.

Furthermore, the lubricant composition may comprise one ore more copper corrosion inhibitors. In one embodiment the copper corrosion inhibitor may be a tolyltriazole. The copper corrosion inhibitor can be used in an amount of 0.001 wt.-% to 5 wt.-%, preferably 0.005 wt.-% to 3 wt.-%, more preferably 0.1 wt.-% to 2 wt.-%, based upon the total weight of the lubricant composition.

In one embodiment the lubricant composition may comprise one or more demulsifying agents, such as trialkyl phosphates, polyethylene glycols, polyethylene oxides, polypropylene oxides and (ethylene oxide-propylene oxide) polymers.

A typical lubricant composition according to the invention may comprise the components according to table 1. In table 1 the ranges provided for component (A) and component (B) refer to wt.-% phosphorus based on the total weight of the lubricant composition. The ranges provided for component (C) refer to wt.-% sulfur based on the total weight of the lubricant composition. The ranges provided for the detergent refer to wt.-% calcium based on the total weight of the lubricant composition. The ranges provided for the remaining compounds refer to wt.-% of the respective compound based on the total weight of the lubricant composition.

TABLE 1

| Component | General | Preferred |
|---|---|---|
| Component (A) | 0.01-0.08 wt.-% P | 0.02-0.07 wt.-% P |
| Component (B) | 0.01-0.08 wt.-% P | 0.02-0.07 wt.-% P |
| Component (C) | 0.01-0.50 wt.-% S | 0.025 wt-% S |
| Detergent | 0.01-0.80 wt.-% Ca | 0.33 wt.-% Ca |
| Dispersant | 0.01-2 wt.-% | 0.2 wt.-% |
| EP agent | 0-2 wt.-% | 0-0.1 wt.-% |
| Rust inhibitor | 0.001-2 wt.-% | 0.5 wt.-% |
| Copper corrosion inhibitor | 0.001-2 wt.-% | 0.006 wt.-% |
| Antifoam agent | 0.001-2 wt.-% | 0.005 wt.-% |
| Base oil | Balance | Balance |

In one embodiment the lubricant composition may be a Caterpillar TO-4 compliant lubricant composition. Accordingly, the lubricant composition may be suitable for off-road applications. In particular the lubricant composition may be free of molybdenum containing friction modifiers and/or free of glycerol monooleate. Therefore, the dynamic and static friction properties as determined by the SEQ 1223 friction test according to the CAT TO-4 specification may be further improved.

EXAMPLES

The inventors have prepared a series of working examples E1 to E5 and comparative examples C1 to C8 as listed in table 2 below. All working and all comparative examples are lubricant compositions comprising the components according to table 1. The only parameters that were varied are the amounts of ashless component (A) and component (B). The amounts of the remaining components were kept constant for all working and all comparative examples.

The following tests were conducted to evaluate the working and the comparative examples:

FZG Scuffing Test

The FZG scuffing test method is used to evaluate the scuffing load capacity of lubricant compositions. The test method is ASTM D5182 of 2008 which is a standard method used to evaluate the scuffing load capacity of fluids. The test method evaluates gear tooth face scuffing resistance of fluids using "A" profile gears. The rig is operated at 1450 rpm through up to 12 progressive load stages at 15 minute intervals. Standard tests are run at a fluid temperature of 90° C. The test procedure commences with a comparatively small pre-load of the meshed gears and after a 15 minute test duration the gear teeth are inspected for scuffing. If the gear teeth are determined to have a pre-assigned amount of scuffing the test is considered a fail at that load stage and the test is terminated at that point. If the gear teeth do not have a pre-assigned amount of scuffing an additional load is added to the meshed gear teeth and the test run for a further 15 minutes. This mode of operation is continued until either the gear teeth are determined to have failed at a particular load stage or load stage 12 is reached without failure. There are no load stages above load stage 12, therefore if a fluid is deemed to have acceptable performance after load stage 12 the test is terminated. In addition to a visual evaluation of gear tooth condition, gear weight loss is measured.

In order for a fluid to meet the requirements of Caterpillar TO-4 the performance in the ASTM D5182 of 2008 FZG scuffing test must meet the minimum required performance standards as follows:

TABLE 2

| SAE viscosity grade | Minimum passing load stages |
|---|---|
| 10W | 8 |
| 30W | 8 |
| 40W | 10 |
| 50W | 10 |

Copper Corrosion Test

The working and comparative examples were subjected to a modified version of the ASTM D130 of 2012 procedure in which copper strips are immersed in the lubricant oil for a set duration and given temperature. At test completion, the copper strips are evaluated on the basis of appearance and weight loss, and the oil is evaluated for levels of copper. Higher levels of weight loss and/or copper in oil indicate the corrosiveness of the lubricant oil to copper. In the working and comparative examples, the temperature was held at 150° C. for 186 hours.

In table 3 the test results show whether gear distress was identified by either "pass" or "fail" test results. Thus, "fail" indicates that significant copper strip weight loss was observed at the end of test (>50 mg weight loss. "EOT mg loss" refers to the amount of copper removed from the copper strip during the test. It is evidence of the corrosivity of the lubricant composition to copper.

ZF Bearing Pitting Test (Entwicklung eines Lagerpittingtests fuer KNKW-Getriebeoele), NO.: 0000 702 232.

This version replaced 0000 702 232C, 09-10-10 and includes new test bearings with a new cage, having 15 rollers (instead of the previous 17) and a reduction of axial force from 70 kN to 68 kN. Lubricant compositions that passed both the copper corrosion test and the FZG scuffing test were subjected to an ZF bearing pitting test. As ZF bearing pitting test a modified ZF bearing pitting test (ZF Lagerpittingtest) No. 0000 702 232 of 2011-03-21 was conducted. The test consists of FE-8 cylinder roller thrust bearings operated at a fluid temperature of 100° C. The bearings are rotated at 300 rpm until sufficient wear occurs to cause excessive vibration, at which time the test is stopped. The "hours to failure" indicate the running time until excessive vibration. A duration in excess of 100 hours indicates a passing lubricant composition, while those below indicate a failing lubricant composition.

TABLE 3

| | Total P (wt.-%) | Comp. (B) (wt.-% P) | Ashless Comp. (A) in (wt.-% P) | Copper corrosion (EOT mg loss) | FZG load stage (LS pass) | bearing pitting (hours) | Copper corrosion (<50 ppm) | FZG load stage (LS 12 pass) | bearing pitting (>100 hours) |
|---|---|---|---|---|---|---|---|---|---|
| E1 | 0.130 | 0.065 | 0.065 | 26 | 12 | 306 | Pass | Pass | Pass |
| E2 | 0.100 | 0.050 | 0.050 | 27 | 12 | 141 | Pass | Pass | Pass |
| E3 | 0.076 | 0.055 | 0.021 | 8 | 12 | 134 | Pass | Pass | Pass |
| E4 | 0.086 | 0.022 | 0.064 | 1 | 12 | 750 | Pass | Pass | Pass |
| E5 | 0.070 | 0.035 | 0.035 | 4 | 12 | 267 | Pass | Pass | Pass |
| C1 | 0.132 | 0.132 | 0 | 60 | — | — | Fail | — | — |
| C2 | 0.101 | 0.101 | 0 | −3 | 12 | 55 | Pass | Pass | Fail |
| C3 | 0.070 | 0.070 | 0 | 3 | 12 | 89 | Pass | Pass | Fail |
| C4 | 0.117 | 0.088 | 0.029 | 62 | — | — | Fail | — | — |
| C5 | 0.115 | 0.029 | 0.086 | 121 | — | — | Fail | — | — |
| C6 | 0.130 | 0 | 0.130 | 135 | — | — | Fail | — | — |
| C7 | 0.100 | 0 | 0.100 | 75 | — | — | Fail | — | — |
| C8 | 0.070 | 0 | 0.070 | 264 | — | — | Fail | — | — |

Table 3 shows that working examples E1 to E5 passed the copper corrosion test, the ZF bearing pitting test and the FZG load stage test. All working examples E1 to E5 comprise ashless component (A) as well as component (B), wherein component (A) provides to the lubricant composition from 0.010 to 0.080 wt.-% phosphorus based on the total weight of the lubricant composition and component (B) provides to the lubricant composition from 0.010 to 0.080 wt.-% phosphorus based on the total weight of the lubricant composition.

Comparative examples C1 to C3 which do not contain ashless component (A) failed either the copper corrosion test or the ZF bearing pitting test in spite of comprising a wide range of component (B). Comparative examples C4 and C5 comprising both, ashless component (A) and component (B), failed the copper corrosion test. In comparative example C4 component (B) provides more than 0.08 wt.-% phosphorus based on the total weight of the lubricant composition. In comparative example C5 ashless component (A) provides more than 0.08 wt.-% phosphorus based on the total weight of the lubricant composition. Comparative examples C6 and C8 which do not contain component (B) failed the copper corrosion test in spite comprising a wide range of ashless component (A).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

The invention claimed is:

1. A transmission fluid composition for off-road vehicles and/or off-road machinery comprising:

(i) a base oil, (ii) at least one ashless component (A) having the structure $P(=S)(SR^1)(OR^2)(OR^3)$, wherein le is selected from the group consisting of an alkyl having 3 to 8 carbon atoms, a carboxylic acid group having 3 to 8 carbon atoms and an ester group having 3 to 8 carbon atoms, $R^2$ and $R^3$ are independently selected from the group consisting of alkyl, aryl, alkylaryl, cycloalkyl, alcohol, carboxylic acid and ester having 3 to 8 carbon atoms, wherein $R^1$, $R^2$ and $R^3$ optionally independently include at least one heteroatom selected from the group consisting of sulfur, oxygen or nitrogen;

(iii) at least one component (B) being a metal dialkyl dithio phosphate salt, wherein the component (B) comprises at least one zinc dialkyl dithio phosphate represented by the following formula:

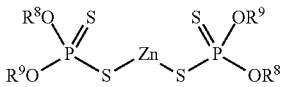

wherein $R^8$ and $R^9$ may be the same or different alkyl groups containing from 1 to 18 carbon atom, wherein 100 mole percent of the alkyl groups of the at least one component (B) are derived from primary alcohols, wherein the total of ashless components (A) provides to the transmission fluid composition from 0.035 to 0.065 wt. % phosphorus based on the total weight of the transmission fluid composition, the total of components (B) provides to the transmission fluid composition from 0.035 to 0.065 wt. % phosphorus based on the total weight of the transmission fluid composition, the transmission fluid composition meets the requirements to pass ASTM D5182 of the 2008 FZG scuffing test at a minimum of 8 load stages, and the transmission fluid composition meets the requirements to pass ZF bearing pitting test No. 0000 702 232 of 2011-03-21 (15 rollers, 68 kN axial force) when the FE-8 cylinder roller thrust bearings are operated at a fluid temperature of 100 ° C. and the bearings are rotated at 300 rpm.

2. The transmission fluid composition according to claim 1, wherein the alkyl groups of the component (B) are independently selected from ethyl, n-propyl, n-butyl, amyl, n-hexyl, n-octyl, decyl, dodecyl, octadecyl.

3. The transmission fluid composition according claim 1, wherein the total phosphorus content provided by ashless components (A) and components (B) is from 0.07 to 0.13 wt. % phosphorus based on the total weight of the transmission fluid composition.

4. The transmission fluid composition according to claim 1, wherein the ratio of wt. % phosphorus based on the total weight of the transmission fluid composition provided by component (A) to wt. % phosphorus based on the total weight of the transmission fluid composition provided by component (B) is from 1:4 to 4:1.

5. The transmission fluid composition according to claim 1, wherein the transmission fluid composition further comprises at least one overbased alkaline earth metal sulfonate detergent.

6. The transmission fluid composition according to claim 5, wherein the overbased alkaline earth metal sulfonate is formed of a sulfonic acid prepared by sulfonating an aromatic compound alkylated with an alkyl group made by a process comprising oligomerizing an olefin containing from 3 to 10 carbon atoms, wherein said alkyl group contains 16 to 40 carbon atoms.

7. The transmission fluid composition according to claim 6, wherein said olefin is selected from the group consisting of propylene and butylene.

8. The transmission fluid composition according to claim 7, wherein said olefin is butylene and said alkyl group contains an average of between 16 and 24 carbon atoms.

9. The transmission fluid composition according to claim 5, wherein said overbased alkaline earth metal sulfonate detergent is an overbased calcium sulfonate detergent.

10. The transmission fluid composition according to claim 9, wherein said overbased calcium sulfonate detergent has a Total Base Number (TBN) ranging from 200 to 400 mg KOH/g.

11. A method of lubricating off-road vehicles and/or off-road machinery comprising providing to the off-road vehicle and/or machinery, a transmission fluid composition comprising:

(i) a base oil, (ii) at least one ashless component (A) having the structure $P(=S)(SR^1)(OR^2)(OR^3)$, wherein le is selected from the group consisting of an alkyl having 3 to 8 carbon atoms, a carboxylic acid group having 3 to 8 carbon atoms and an ester group having 3 to 8 carbon atoms, $R^2$ and $R^3$ are independently selected from the group consisting of alkyl, aryl, alkylaryl, cycloalkyl, alcohol, carboxylic acid and ester having 3 to 8 carbon atoms, wherein $R^1$, $R^2$ and $R^3$ optionally independently include at least one heteroatom selected from the group consisting of sulfur, oxygen and nitrogen; and (iii) at least one component (B) being a zinc dialkyl dithio phosphate salt, wherein the component (B) comprises at least one zinc dialkyl dithio phosphate represented by the following formula:

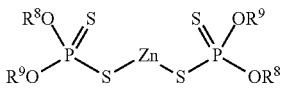

wherein $R^8$ and $R^9$ may be the same or different alkyl groups containing from 1 to 18 carbon atom, wherein 100 mole percent of the alkyl groups of the at least one component (B) are derived from primary alcohols, wherein the total of ashless components (A) provides to the transmission fluid composition from 0.035 to 0.065 wt. % phosphorus based on the total weight of the transmission fluid composition, the total of components (B) provides to the transmission fluid composition from 0.035 to 0.065 wt. % phosphorus based on the total weight of the transmission fluid composition, the transmission fluid composition meets the requirements to pass ASTM D5182 of the 2008 FZG scuffing test at a minimum of 8 load stages, and the transmission fluid composition meets the requirements to pass ZF bearing pitting test No. 0000 702 232 of 2011-03-21 (15 rollers, 68 kN axial force) when the FE-8 cylinder roller thrust bearings are operated at a fluid temperature of 100 ° C. and the bearings are rotated at 300 rpm, and operating the off-road vehicle and/or machinery.

12. The transmission fluid composition according to claim 1, wherein $R^1$ is an ester group having 3 to 8 carbon atoms, $R^2$ and $R^3$ are independently selected from an alkyl group having 3 carbon atoms.

13. The transmission fluid composition according to claim 1, further comprising at least one component (C) comprising a thiadiazole or derivative thereof.

14. The transmission fluid composition according to claim 13, wherein component (C) is selected from the group consisting of 2-hydrocarbyldithio-5-mercapto-1,3,4-thiadiazole or 2,5 -bis-(hydrocarbyldithio)-1,3,4-thiadiazole.

15. The transmission fluid composition according to claim 14, wherein component (C) is present in an amount sufficient to provide to the transmission fluid composition from 0.010 to 0.5 wt. % sulfur based on a total weight of the transmission fluid composition.

* * * * *